United States Patent [19]

Nossum

[11] 4,007,615

[45] Feb. 15, 1977

[54] KEY CONTROLLED PICK RESISTANT LOCK

[76] Inventor: Knut Nossum, 707 Lowry Ave. NE., Minneapolis, Minn. 55418

[22] Filed: June 1, 1976

[21] Appl. No.: 691,419

[52] U.S. Cl. ..... 70/387; 70/352; 70/405

[51] Int. Cl.[2] ..... E05B 35/04; E05B 63/22

[58] Field of Search ..... 70/387, 345, 352, 350, 70/353, 355, 362, 363, 405

[56] References Cited

UNITED STATES PATENTS

| | | | |
|---|---|---|---|
| 226,107 | 3/1880 | Reinhart | 70/387 |
| 664,674 | 12/1900 | Petersen | 70/387 X |
| 665,232 | 1/1901 | Kossov | 70/387 |
| 1,193,412 | 8/1916 | Nelson | 70/387 X |
| 2,656,707 | 10/1953 | Nilsson | 70/352 |

*Primary Examiner*—Robert L. Wolfe

*Attorney, Agent, or Firm*—Schroeder, Siegfried, Ryan & Vidas

[57] ABSTRACT

A push key type lock mechanism which requires insertion and removal of the key for operating of the associated bolt. The lock mechanism includes an anti-picking device which requires complete key insertion for operation of the lock mechanism to prevent trial and error picking of the lock.

19 Claims, 8 Drawing Figures

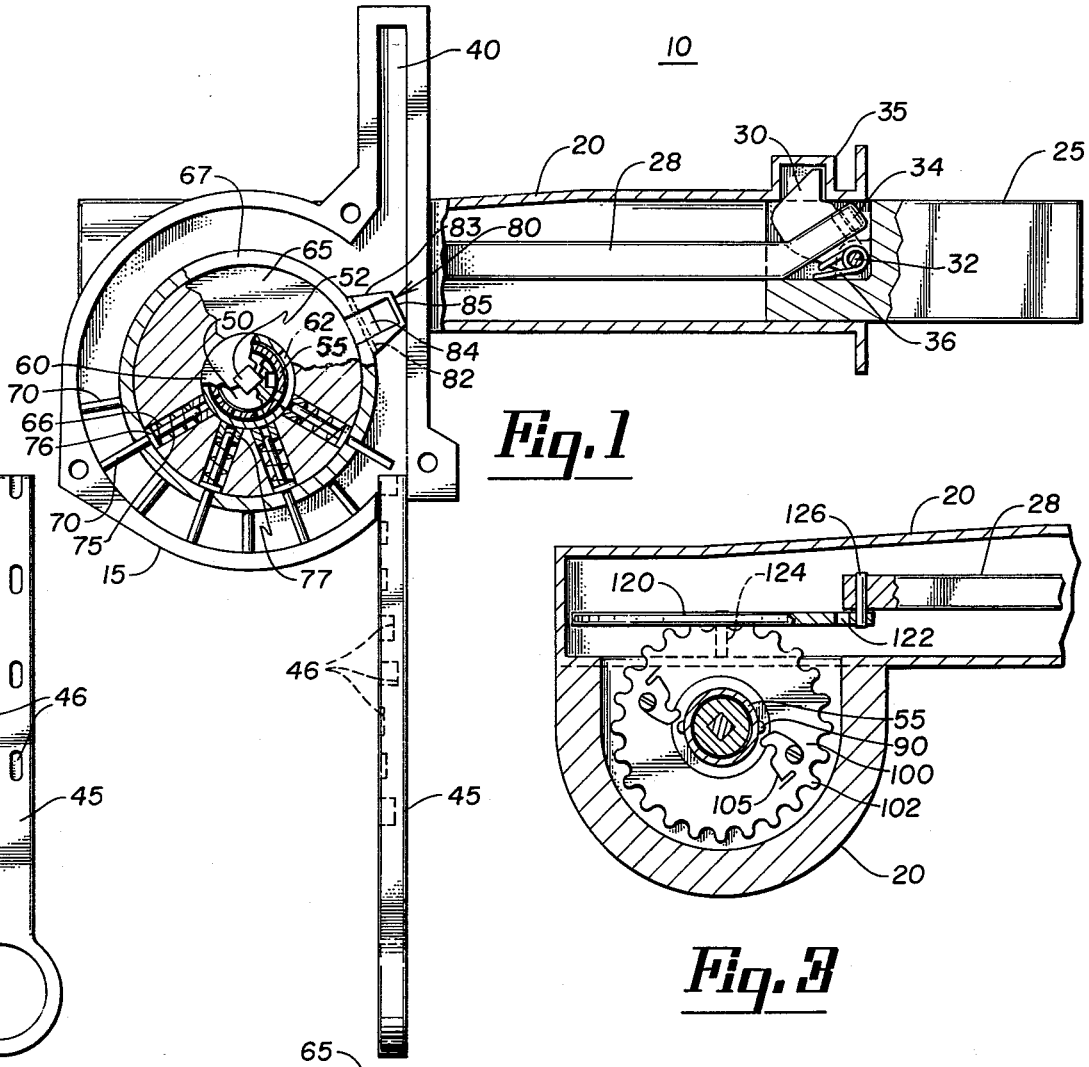
Fig. 1
Fig. 3
Fig. 8
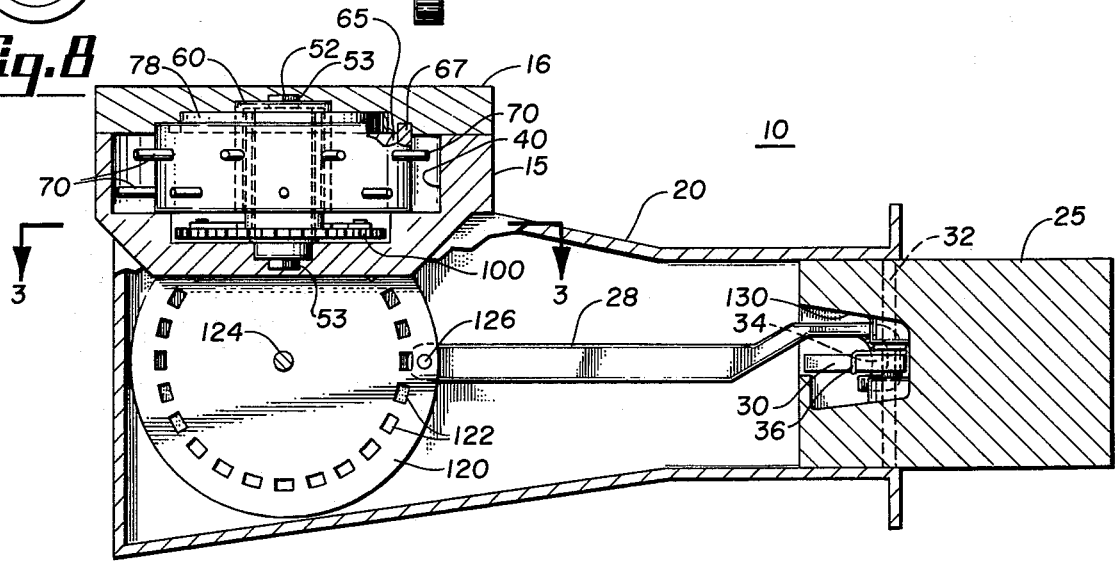
Fig. 2

KEY CONTROLLED PICK RESISTANT LOCK

My invention relates to a lock mechanism and more particularly to a push key type lock which requires insertion and removal of the key for operation of the lock.

Lock mechanism are well known and take a variety of forms. Similarly, push key type lock mechanisms are known and in use. Most lock mechanism, whether they employ tumbler and turn key type operation or a push key type operation are susceptable to tampering in that no definite or set sequence of opening operation is required to operate the lock.

The present invention is directed to a relatively tamper-proof lock mechanism which requires insertion of a key and removal of the same in a timed sequence for either opening the lock or closing the lock. The improved lock mechanism includes a plurality of tamper-proof provisions in that if the key is not properly shaped for lock operation, insertion of the key will be prevented or stopped and hence, rotation of the lock part stopped, at any point of incongruence between key and lock mechanism. Further the improved lock mechanism includes a tamper-proof or pick-proof feature which requires that the key is inserted all of the way into the keyway to properly operate the lock parts in a timed sequence or rotation of the lock parts will be prevented. Thus, operation of the lock by picking is highly improbable because of the anti-picking feature which requires that each lock part be operated in a sequence and in a timed interval or the lock parts will be prevented from rotating. The improved lock mechanism requires complete insertion of the key to condition the lock apparatus for bolt opening or closing after which removal of the key will provide the opening or closing function. Thus, it is improbable that improvised keys or pick mechanism may condition the lock for opening and still perform the opening function since the key is required in both the insertion and withdrawing mode for completing the locking or unlocking operation.

Thus, the present invention is directed to the problem of providing an improved lock mechanism for reducing burglaries resulting from lock picking. The lock includes an anti-picking device which prevents picking the lock on a trial and error basis since the lock must be opened by a key in approximately one second. Further, in any picking operation, a pick must be completely removed before another attempt is made to open the lock. This improved lock mechanism includes a cylinder with a plurality of spring loaded pins at varying lengths positioned in radially extending holes in the cylinder and requiring a key having holes of different depths to be inserted into the lock such that when the pins are guided into the holes in the key, they will be pushed through the holes in the cylinder to rotate a second cylinder to condition the lock for the locking or unlocking operation. Thus, the key must be inserted deeper into the keyway to rotate the cylinders to complete the conditioning and when the key has been pushed all the way in, a gripping mechanism can function and the latch bolt will be withdrawn as the key is pulled out.

Therefore, it is the principle object of this invention to provide an improved lock mechanism of a push key type.

Another object of this invention is to provide an improved lock mechanism with anti-picking features.

A further object of this invention is to provide a locking mechanism type in which the locking or unlocking operation must be completed in a relatively short time sequence.

A still further object of this invention is to provide an improved lock mechanism which may be used with any type of bolt or latch type operation.

It is another object of this invention to provide an improved lock mechanism for reducing burglaries resulting from lock picking.

These and other objects of the invention will become apparent from the reading of the attached description together with the drawings wherein:

FIG. 1 is a plan view of the parts of the lock mechanism with the top cover removed and the bolt housing broken away showing the lock bolt mechanism and the key entrance to the lock mechanism.

FIG. 2 is a side elevation view of the lock mechanism of FIG. 1 with the lock housing broken away and with the cover on the bolt mechanism away.

FIG. 3 is a sectional view taken along the lines 3—3 in FIG. 2 and with parts broken away;

FIG, 6 is a front elevation view of the inner cylinder and hood portion of the lock mechanism together with the support for the same.

Figure 6:
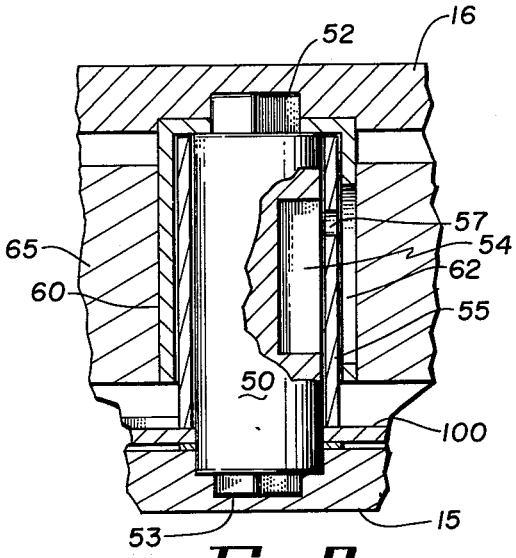
Figure 7:
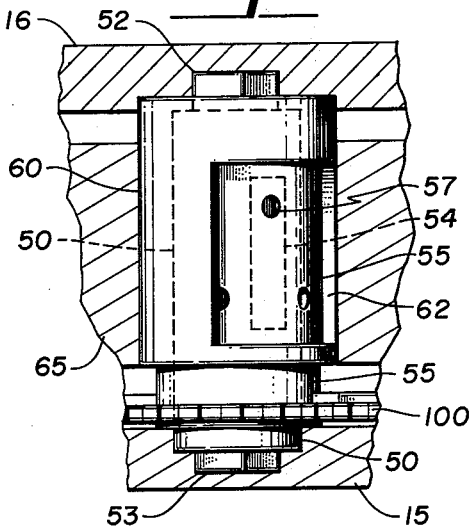

FIG. 7 is a side elevation view of FIG. 6.

FIG. 8 is a plan view of the key for the improved lock mechanism.

My improved lock mechanism is shown generally in FIG. 1 at 10. It is a plan view of the lock mechanism 10 with the cover of the lock housing removed and a bolt housing 20 broken away. The lock housing is indicated generally at 15 with a cover 16 and the bolt housing is indicated at 20. The bolt housing 20 mounting a slidably positioned bolt 25 which is adapted to fit into any structure with which an associated structure mounting the lock housing or lock mechanism will be relatively moved. Thus, in FIG. 1, the bolt 25 will be slidably positioned in the end of the bolt housing 20 through a lever 28 for longitudinal movement within the housing 20. As shown in FIG. 1, a secondary pivoted linkage 30 is pivotally mounted in the bolt, as at 32, and attached to the end of the lever 28, as at 34, to provide a secondary pivot, the secondary bolt or linkage having a projection fitting into a flange portion 35 of the bolt housing and biased through a spring 36 in the flange portion to provide a secondary latching function in the longitudinal direction of movement. The bolt and lock housings 15, 20 may be formed, integrally or suitably attached by screw means, not shown.

The lock housing 15 includes a keyway 40 adapted to receive a key 45 which will be slidably positioned therein, the key being a push type for operating of the locking mechanism as will be later noted.

Within the lock housing 15 is positioned a centrally located cylindrical shaft 50 which shaft mounts an inner cylindrical member 55. The shaft 50 has squared ends 52 which fit into squared recessed 53 in cover 15 and housing 15 to position the same therein. Positioned over the inner cylindrical member is a stationary annular hood 60, the hood in turn mounting an annular outer cylindrical member 65 and journaling the same thereon. The inner cylindrical member is journaled on the shaft 50 and the hood 60 includes a closed end with a squared recess 62 which fits over the squared end 52 of the shaft 50 in the cover 16 to mount the hood on the shaft and permit movement of the inner cylindrical member therein.

The outer cylindrical member has a plurality of apertures 66 therein extending radially from the hood through the outer cylindrical member 65. Positioned in the apertures are a plurality of pin members 70 each pin being of different length and having an associated spring 75 surrounding the same and bearing against a head portion 76 of the pin to bias the pins in a direction out of the cylindrical member and against the inner wall of the generally circular lock frame or housing 15. An annular rim 67 with holes therein is positioned over the cylindrical member 65 so that the pins 70 may project them through and be retained in the cylindrical member. It extends beyond the cylindrical member and rides in an annular groove in the cover 16 to aid in journaling the outer member on hood 60. A plug member 77 is frictionally retained in each aperture to retain the pins therein and permits removal of the same to change pins. The hood 60 has a window 62 therein which is generally arcuate and exposes a portion of the circumferential surface of the inner cylindrical member 55. The inner cylindrical member 55 has a similar plurality of apertures 57 therein which apertures are symmetrically located with respect to the apertures 66 in the cylindrical member 65. These apertures 57 are of a dimension to receive the pins 70 as they extend through the outer cylindrical member and the window 62.

As will be seen in FIG. 1, the plurality of pins, preferably 5 to 8, cover substantially 180° of the cylindrical surface of the outer cylindrical member 65 and the arcuate window in the hood 60 covers approximately 90° and is disposed adjacent the keyway 40 within the lock housing. The same arrangement of apertures, preferably staggered as well as distributed circumferentially is present in the inner cylindrical member. The key 45, as will be seen in FIG. 8, includes a plurality of indentations or recessed surfaces 46 along the extent of the same having varying depths and exposed on one surface of the key. This surface when positioned in the keyway, permits the relatively flat key will slide into proximity with the pins 70 and engage the ends of the same, with the ends of the pins fitting into the recesses 46 and urging the pins against the bias of the springs 75 to slide in the recesses 66. As the key is pushed forward into the keyway 40, the pins fitting into the recesses 46 will rotate the outer cylindrical member and urge the pins inwardly toward the inner cylindrical member in a sequence through the window 62 of the hood 60 and into contact with the inner cylindrical member and the recesses 57 therein. As the pins enter the inner cylindrical member, they will cause the same to rotate with the outer cylindrical member in the operation of the lock mechanism. The pins 70 being of varying lengths, require that the indentations or recesses 46 in the key be of different depths in order that the pins as they are rotated and slide in the respective recesses will properly fit into the apertures in the inner cylinder to rotate the same with the outer cylinder as the key is inserted into the keyway. A coil spring 78 is positioned in the cover 16 and attached between the squared end 52 of the shaft 50 and the outer cylindrical member to bias the outer cylindrical member opposite to the direction of rotating the outer cylindrical member with key withdrawal.

In the event the depths 46 or recesses in the key are not congruent with the pin lengths, that is, do not correspond properly with the lengths of the pins, for proper key operation, the pins will either not be advanced sufficiently into the window 62 to engage the apertures in the inner cylindrical member to cause rotation of the same or will project too far through the apertures in the inner cylindrical member 55 such as to project into a recess or slot 54 in the shaft 50. Under these conditions, a pin projecting through the inner cylindrical member and into the slot 54 will prevent further rotation of the inner and outer cylindrical members by being wedged against the sides of the slot 54 in the shaft 50. Thus, as will be seen in FIG. 1, only the pins in the outer cylindrical member adjacent the window 62 and extending into the keyway to be engaged by the key will be effective to rotate the inner cylindrical member and the proper sequence of depth of apertures or recesses 46 in the key is required to provide rotation of the outer and inner cylindrical members as the key is inserted into the keyway.

Figure 4:
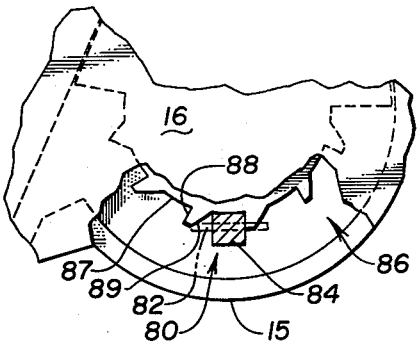
FIG. 4 is a plan view of the anti-picking portion of the lock mechanism in a locked position.
Figure 5:
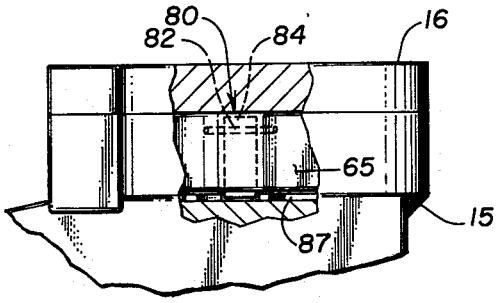
FIG. 5 is an elevation view of the anti-picking mechanism of FIG. 4.

The outer cylindrical member 65 includes an antipicking device indicated generally at 80. The anti-picking device, as will be seen in FIGS. 4 and 5, includes a shaft member 82 mounting a pendulum or rod 84 of non-magnetic material thereon which hangs down into proximity with a toothed surface 86 in the base of the housing 15. The shaft member 82 is mounted on a U-shaped flange structure 83 attached to a formed integral with the outer cylindrical member 65 with a cover 85 over the same. The toothed surface 86 as will be seen in FIGS. 4 and 5 defines a plurality of slots or recesses 87 which have a leading face 88 which is relatively straight and a trailing face 89 which is beveled with the start position having beveled faces on each surface thereof to initiate movement of the outer cylindrical member. The anti-picking device prevents trial and error picking of the lock mechanism since it is necessary that the key be inserted into the keyway without stopping, that is, in a generally timed sequence to permit the outer cylindrical member to rotate at such a speed that the pendulum will move away from the recesses 87 and the end of the same will clear the straight surfaces 88 of the detents 86 as the outer cylindrical member is rotated. Any stopping will allow the pendulum to drop back into the recesses bearing against the straight surface to prevent further rotation in a counterclockwise direction as seen in FIG. 1 and FIG. 4. The rod 84, being of non-magnetic material, cannot be effected or displaced by an external magnetic source. It will be noted that the opposite surfaces 89 of the detents 86 of the anti-picking device 80 are sloped surfaces so that upon rotation of the outer cylindrical member in a reverse direction or clockwise direction the end of the pendulum or anti-picking member 84 will ride out of the slots to clear the same allowing free movement in the clockwise direction of rotation of the outer cylindrical member with the aid of spring 78. Thus, as the key 45 is pushed into the keyway, it must be completely inserted into the keyway within a given period of time sufficient to cause the outer cylindrical member to rotate such that the anti-picking device will not come into play. This is approximately a few seconds time. Any delay either by the person inserting the key or someone attempting to trial and error pick the lock to attempt to manipulate the pins individually will result in the anti-picking device or pendulum lodging against the straight surfaces 88 of the detent or in the recesses 87 thereof to prevent further rotation and requiring removal of the key before the lock can be further operated or the key further inserted.

As will be best seen in FIG. 3, the end of the inner cylindrical member 55 near the base of the lock housing 15 has a pair of projecting detent members 90 which are spaced 180° from one another. Position below the same and journaled on the shaft 50 is a cog wheel or gear 100 having a plurality of teeth 102 thereon and mounting a pair of gripping members 105 which gripping members are similarly spaced 180° from one another and are pivoted on the upper surface of the cog wheel to cooperate with the detent members or the tabs 90 on the end of the inner cylindrical member 55. When the key 45 has the proper indentations 46 therein to correspond with the length of the pins, insertion of the key into the keyway 40 will rotate the outer and inner cylindrical members simultaneously an arcuate distance slightly greater than 180°. The detent members are shown positioned with respect to the spring biased gripper members 105 on the cog wheel 100 that at the end of travel of the key, the inner cylindrical member will be rotated such that the detent members 90 will be behind the gripper members 105. Reciprocation of the key in the opposite direction will cause both the inner and outer cylindrical members to reverse their direction of rotation and the detent members operating against the gripper members will cause rotation of the cog wheel through 180° rotation. This rotation of the cog wheel 100 is unidirectional and with each new key insertion, the inner cylindrical member 55 will rotate the tabs past the gripper members 105 near the end of its travel or rotation so that upon reverse rotation it will pick up the gripper members and rotate the cog wheel in a clockwise direction 1180° as seen in FIG. 3. The cog wheel 100 or the teeth 102 thereon meshes with similar teeth or a toothed surface 122 in a second cog wheel 120 which is rotationally mounted in the housing 20 or bolt housing through a pivot member 124 and disposed in a plane such that the teeth thereof are normal to the teeth of the cog wheel 100 and mesh therewith. Cog wheel 120 pivotally mounts one end of the lever 28 through a pivot 126 so that as the second cog wheel or gear 120 is rotated 180° the lever 28 will move longitudinally in the bolt housing 20 as the cog wheel 120 rotates through 180°. This cog wheel or gear 120 similarly rotates unidirectionally so that upon next rotation it will continue its circular movement urging the lever in the opposite direction to move the bolt 25 connected thereto out of the bolt housing or in a direction opposite the first movement. As will be seen in FIGS. 1 and 2, the free end of the lever 28 has a bent flange portion 34 thereon which bears against the pivoted lever 30 in the bolt to couple the bolt to the lever 28. The bolt has slopped surfaces 130 wherein which permits the up/down movement of the lever 28 as it rides in a circular path with rotation of the gear or second cog wheel 120. This connection may be varied, and the auxiliary lever member 30 provides an additional locking surface normal to that of the bolt. The end of the lever 28 will provide the surface to urge the bolt 25 out of the housing 20 and the coupling of the lever 28 as at 34 with the lever 30 will permit the bolt to be slidably moved to the interior of the bolt housing 20.

Thus, my improved lock mechanism of the push key type prevents or discourages attempts to picking or the use of an improper key mechanism by responding only to the particular key whose notches are referenced to a particular dimension commensurate with the length of the associated pins so that the inner and outer cylindrical member of the lock mechanism may be rotated simultaneously through an entire range of movement, slightly over 180°, as the key is completely inserted into the keyway. Only that particular pin in proximity with the window may be manipulated by the key since the protective hood covers the aperture in the inner cylindrical member. Similarly, the anti-pick mechanism requires that the lock mechanism be operated in a timed sequence, that is completely rotated with complete insertion of the key so that the pendulum thereof will clear the locking detents. Any attempt to partially rotate the inner and outer cylindrical members will result in an anti-picking mechanism coming into play by locking the cylindrical members against rotation in the clockwise direction corresponding to key insertion. Similarly the anti-picking device, being non-magnetic, and enclosed cannot be influenced by external magnetics or manipulated externally. Once the key is completely inserted, withdrawal of the key will operate the bolt mechansim through the gripper members riding against the tabs 90 on the inner cylindrical member and with the opposite direction of rotation to rotate the meshing cog wheels 180° and translationally move the bolt within the bolt housing. As will be understood, the bolt mechanism may take varying forms and the interconnection between the lock housing and bolt housing may be separate member structures which are interconnected for the relationship between the cog wheels or they may be single composite unit. As shown in FIG. 2, the lock housing 15 includes the cover 16 to permit removal of the outer and inner cylindrical member 65 for interchange of pins and to change the key.

Therefore, in considering this invention, it should be remembered that the present disclosure is illustrative only and the scope of the invention should be determined by the appended claims.

What I claim is:

1. A lock mechanism operated upon insertion and removal of a key comprising, an enclosing housing and a transversely extending housing containing a latch therein, a shaft mounted in the first housing, an inner cylindrical member journaled on said shaft and having a plurality of spaced apertures therein, a hood carried by said shaft and encircling said inner cylindrical member, said hood having a window therein, an outer cylindrical member journaled on said hood and having a plurality of apertures therein with a spring biased pin mounted in each aperture; said pins being slidably positioned through said outer cylindrical member and adapted to engage the apertures in the inner cylindrical member through said window in said hood; a keyway in said first housing; a key having a surface with a plurality of sequential indentations therein which when inserted into the keyway engage the exposed ends of the pins in the outer cylindrical member to rotate the outer cylindrical member urging said pins into engagement with the apertures with the inner cylindrical member to rotate the inner cylindrical member simultaneously therewith; means included in the inner cylindrical member and the shaft to prevent rotation of the inner and outer cylindrical members in the event the apertures in the key do not cause predetermined engagement of the pins with the inner cylindrical member; means included in part in said enclosing and in part in said outer cylindrical member to prevent rotation of the outer cylindrical member except in a predetermined time sequence with the insertion of said key; and means included in part in said inner cylindrical member and in part with the latch to cause operation of the latch upon complete insertion of the key and subsequent withdrawal of the key.

2. The lock mechanism of claim 1 in which the means to prevent rotation of the inner and outer cylindrical members is a slot in the shaft.

3. The lock mechanism of claim 1 in which the window in the hood has a limited arcuate extent and is exposed only adjacent the keyway.

4. The lock mechanism of claim 2 in which the pins in the outer cylindrical member are advanced into the inner cylindrical member to rotate the same only if the apertures in the key are of a predetermined dimension and in which the pins slide through the apertures in the inner cylindrical member and engage the slot if the depth of the apertures in the key are less than a predetermined dimension.

5. The lock mechanism of claim 1 in which the means included in the outer cylindrical member and in part in the enclosing housing preventing rotation of the outer cylindrical member is a non-magnetic pendulum suspended from the outer cylindrical member and cooperating with detents in the enclosing housing.

6. The lock mechanism of claim 5 in which the detents in the enclosing housing have sloped surfaces in the direction permitting counter-rotation of the outer cylindrical member at any timed sequence upon withdrawal of the key from the lock mechanism.

7. The lock mechanism in claim 1 in which the means included in part on the inner cylindrical member and in part on the latch includes a first and second gear member mounted respectively in the enclosing housing and the transversely extending housing and including detent means on the inner cylindrical member cooperating with gripper means on the first gear causing the first gear member to be driven by the inner cylindrical member in a predetermined direction of movement with key withdrawal.

8. The lock mechanism of claim 7 in which the second gear member includes a pivoted lever attached to the latch and rotating with the second gear member through slightly greater than 180° with each withdrawal of the key.

9. The lock mechanism of claim 8 in which the first and second gear members rotate unidirectionally.

10. The lock mechanism of claim 1 in which the latch means includes a pivoted lever attached to the end of a bolt and a second bolt pivoted thereon to slide into an angular flanged recess in the transversely extending housing with the bolt sliding in the end of the transversely extending housing.

11. The lock mechanism of claim 10 and including spring means positioned between the enclosing housing and the outer cylindrical member biasing the outer cylindrical member in a direction opposite the rotation caused by key isertion.

12. The lock mechanism of claim 1 in which the spring biased pins in the outer cylindrical member are of different lengths.

13. The lock mechanism of claim 12 in which the spring biased pin has a spring positioned in an aperture in the outer cylindrical member encircling the pin and bearing against the flange on the pin and against the outer cylindrical member.

14. The lock mechanism of claim 1 in which the apertures in the inner cylindrical member extends through the inner cylindrical member.

15. The lock mechanism of claim 2 in which the slot in the shaft is positioned behind the window in the hood.

16. The lock mechanism of claim 1 in which the apertures in the inner and outer cylindrical members are aligned with respect to one another and staggered with respect to one another.

17. A lock mechanism operated upon insertion and removal of a key comprising, an enclosing housing and a transversely extending housing containing a latch therein, a shaft mounted in the first housing, an inner cylindrical member journaled on said shaft and having a plurality of spaced apertures therein, a hood carried by said shaft and encircling said inner cylindrical member, said hood having a window therein, an outer cylindrical member journaled on said hood and having a plurality of apertures therein with a spring biased pin mounted in each aperture, said pins being slidably positioned through said outer cylindrical member and adapted to engage the apertures in the inner cylindrical member through said window in said hood; a keyway in said first housing; a key having a surface with a plurality of sequential indentations therein which when inserted into the keyway engage the exposed ends of the pins in the outer cylindrical member to rotate the outer cylindrical member urging said pins into engagement with the apertures with the inner cylindrical member to rotate the inner cylindrical member simultaneously therewith; means included in part in said enclosing and in part in said outer cylindrical member to prevent rotation of the outer cylindrical member except in a predetermined time sequence with the insertion of said key; and means included in part in said inner cylindrical member and in part with the latch to cause operation of the latch upon complete insertion of the key and subsequent withdrawal of the key.

18. A lock mechanism operated upon insertion and removal of a key comprising, an enclosing housing and a transversely extending housing containing a latch therein, a shaft mounted in the first housing, an inner cylindrical member journaled on said shaft and having a plurality of spaced apertures therein, a hood carried by said shaft and encircling said inner cylindrical member, said hood having a window therein, an outer cylindrical member journaled on said hood and having a plurality of apertures therein with a spring biased pin mounted in each aperture, said pins being slidably positioned through said outer cylindrical member and adapted to engage the apertures in the inner cylindrical member through said window in said hood; a keyway in said first housing; a key having a surface with a plurality of sequential indentations therein when inserted into the keyway to engage the exposed ends of the pins in the outer cylindrical member to rotate the outer cylindrical member urging said pins into engagement with the apertures with the inner cylindrical member to rotate the inner cylindrical member simultaneously therewith; means included in the inner cylindrical member and the shaft to prevent rotation of the inner and outer cylindrical members in the event the apertures in the key do not cause predetermined engagement of the pins with the inner cylindrical member; and means included in part in said inner cylindrical member and in part with the latch to cause operation of the latch upon complete insertion of the key and subsequent withdrawal of the key.

19. A lock mechanism operated upon insertion and removal of a key comprising, an enclosing housing and a transversely extending housing containing a latch therein, a shaft mounted in the first housing, an inner cylindrical member journaled on said shaft and having a plurality of spaced apertures therein, a hood carried by said shaft and encircling said inner cylindrical member, said hood having a window therein, an outer cylindrical member journaled on said hood and having a plurality of apertures therein with a spring biased pin mounted in each aperture, said pins being slidably positioned through said outer cylindrical member and adapted to engage the apertures in the inner cylindrical member through said window in said hood; a keyway in said first housing; a key having a surface with a plurality of sequential indentations therein which when inserted into the keyway engage the exposed ends of the pins in the outer cylindrical member to rotate the outer cylindrical member urging said pins into engagement with the apertures with the inner cylindrical member to rotate the inner cylindrical member simultaneously therewith; and means included in part in said inner cylindrical member and in part with the latch to cause operation of the latch upon complete insertion of the key and subsequent withdrawal of the key; and means coupling the inner cylindrical member to said latch after the inner and outer cylindrical members have been rotated with complete key insertion and upon the withdrawal of the key to operate the latch.

* * * * *